United States Patent [19]

Dlugokecki

[11] Patent Number: 4,813,856

[45] Date of Patent: Mar. 21, 1989

[54] BALANCED ROTARY VALVE PLATE FOR INTERNAL GEAR DEVICE

[75] Inventor: Andrew N. Dlugokecki, Bridgton, Me.

[73] Assignee: Parker-Hannifin Corporation, Cleveland, Ohio

[21] Appl. No.: 82,754

[22] Filed: Aug. 6, 1987

[51] Int. Cl.[4] ..... F01C 1/113; F16K 3/30

[52] U.S. Cl. ..... 418/61.3; 137/625.21

[58] Field of Search ..... 418/61 B; 137/625.21; 251/283

[56] References Cited

U.S. PATENT DOCUMENTS

| | | | |
|---|---|---|---|
| 3,743,450 | 7/1973 | Woodling | 418/61 B |
| 4,232,708 | 11/1980 | Miller | 418/61 B |
| 4,501,536 | 2/1985 | Middlekauff | 418/61 B |
| 4,575,321 | 3/1986 | Petersen et al. | 137/625.21 |

*Primary Examiner*—John J. Vrablik

*Attorney, Agent, or Firm*—Christopher H. Morgan

[57] ABSTRACT

An improved rotary valve plate and internal gear machine wherein an imbalance across the rotary valve plate due to high pressure fluid on the commutator side of the valve plate being opposite low pressure fluid in the variable displacement chambers on the gear side of the valve plate is balanced by a recess which extends around the periphery of the valve plate and receives fluid from the gear side of the valve plate to urge the valve plate toward the commutator. Preferably, the internal gear machine is of a type with an orbiting outer rotor orbiting in an annulus with intermediate pressure fluid in the annulus. The recess on the gear side of the valve plate is disposed to receive intermediate pressure fluid from the annulus.

1 Claim, 4 Drawing Sheets

BALANCED ROTARY VALVE PLATE FOR INTERNAL GEAR DEVICE

BACKGROUND OF THE INVENTION

1. Field of the Invention

The present invention relates generally to gerotor hydraulic devices that can be used as pumps or motors and, more particularly, to such devices having a rotary valve plate therein.

2. Description of the Prior Art

Many types of prior art hydraulic devices have utilized internal gear sets which are often called gerotors or rotors. Such devices can be used as pumps where shaft work is converted to hydraulic work and as motors where hydraulic work is converted to shaft work. Examples of gerotor pumps and motors are shown in U.S. Pat. Nos. 3,572,983; 4,411,607; 4,545,748; and 4,586,885. In an internal gear pump or motor, an inner gear having outwardly directed teeth cooperates with an external gear having inwardly directed teeth so that fluid chambers therebetween increase and decrease in volume as the inner and outer gears rotate in a housing. By connecting the inlet and outlet of the device to the proper location along the sides of the gear set, the variable displacement chambers receive and discharge hydraulic fluid so that the device can function as a pump or motor. A shaft or other mechanical device can be connected to either the inner or outer gear depending upon the type of device.

Many of the internal gear pumps and motors of the prior art utilize a housing having a fixed inlet and outlet. In other gerotor pumps and motors, a rotary valve plate or disc is used. An example of gear devices with a rotary valve plate are shown in U.S. Pat. Nos. 4,411,607; 4,545,748; 4,586,885; and applicant's co-pending U.S. patent application No. 860,715, filed May 6, 1986 now U.S. Pat. No. 4,699,577. As described in these patents, the internal gear devices with rotary valves have a control plate or commutator with a plurality of inlet and outlet openings or windows on an axial face thereof. A valve plate with a plurality of openings extending axially therethrough is disposed between the gear set and the commutator to selectively communicate the inlet and outlet openings with the variable displacement chambers in the gear set. The valve plate is connected to rotate with the gear set such that the closing variable displacement chambers in the gear set are connected with the outlet openings of the commutator while the opening variable displacement chambers of the gear set are connected with the inlet.

A well known problem which occurs in devices with rotary valve plates is that the valve plate is subject to a tilting moment caused by high pressure fluid bearing against one radial half of the valve plate, while low pressure fluid bears against the other radial half of the valve plate. In addition, there is a relatively larger area of pressure bearing on the gear set side of the valve plate than on the commutator side of the valve plate. The combination of this pressure imbalance reduces the efficiency and operational life of the device by increasing friction and wear on the moving components.

A partial solution to the imbalance is shown in U.S. Pat. No. 4,411,607. In this patent, recesses and grooves are provided on the rotary valve face on the commutator side of the rotary valve plate. These recesses provide a greater fluid pressure area on the commutator side of the valve plate to counterbalance the normally greater area of fluid pressure on the gear set side of the valve plate. However, the imbalance of high pressure from the commutator ports on one radial half (commutator side) of the valve plate versus low pressure on the same radial half (gear set side) partially remains.

In applicant's co-pending patent application Ser. No. 860,715 a further means of balancing the imbalance is shown. This is achieved by ports which extend through the valve plate to communicate high pressure fluid on the commutator side of the valve plate to a peripheral groove on the low pressure gear set side of the valve plate. These ports are selectively communicated with the high pressure in the commutator openings by the rotation of the valve. Thus, the radial half of the control plate which is not balanced due to high pressure commutator ports being opposite low pressure displacement chambers in the gear set are balanced by an area of high pressure fluid on the gear set side communicated through the special ports. However, some leakage of this high pressure fluid into the low pressure variable displacement chambers in the gear set occurs causing a reduction in efficiency of the motor or pump which would not occur if the leakage were not present. Further, this solution is not possible on machines where the outer rotor orbits as opposed to the inner rotor orbiting.

It is accordingly an object of the present invention to provide an internal gear motor or pump with an improved means of balancing the hydraulic pressures on the rotating valve plate. It is also an object of the present invention to provide a valve plate which is of simple construction and which prevents or reduces leakage from the commutator side of the valve plate to the gear set side of the valve plate. It is, still further, an object to provide such improvements for an internal gear machine of the type having an orbiting outer gerotor.

SUMMARY OF THE INVENTION

In accordance with the objects, the present invention provides an improved internal gear machine of the type described. That is, the internal gear machine includes a gear set having an inner and outer gear disposed for rotation in a housing such that a plurality of variable displacement chambers are defined between the inner and outer gears as they rotate.

A commutator through which fluid is conveyed to and from the variable displacement chambers is disposed axially with respect to the gear set and has a plurality of commutator openings therein. Part of the commutator openings are connected to an inlet in said housing and part of the commutator openings are connected to an outlet in the housing.

A valve plate is connected for rotation with the gear set and disposed axially between the gear set and the commutator. The valve plate includes a plurality of valve plate openings extending axially therethrough for selectively communicating the commutator openings with the variable displacement chambers of the gear set. The valve plate has a commutator side and a gear set side with the commutator side joining with the commutator to form an interface between the commutator and the valve plate. The interface has a plurality of interface recesses into which fluid is received to partially compensate for tilting moments acting on the valve plate from the fluid pressure in the variable displacement chambers of the gear set.

To further compensate for the tilting moments acting on the valve plate while preventing substantial leakage of fluid from high pressure to low pressure location in the machine, the valve plate is provided with a recess around the periphery of the valve plate which provides a uniform axial pressure to aid the balance provided by the recesses on the commutator side of the valve plate. The recess on the gear set side of the valve plate do not communicate with the commutator side of the valve plate so that no fluid pressure is lost across the valve plate by means of these recesses.

This invention works best in the type of internal gear machine with an orbiting outer rotor which orbits in an annulus having a fluid pressure which is intermediate the fluid pressure in the inlet and outlet. The recess on the gear side of the valve plate communicates directly with the annulus in which the orbiting outer gerotor orbits so that pressure from the intermediate pressure fluid therein urges the valve plate toward the commutator. The size of the recess is adjusted to balance the unbalanced tilting moment on the valve plate resulting from the high pressure fluid in high pressure openings in the commutator bearing against the valve plate opposite low pressure fluid bearing against the gear set side of the valve plate.

For a further understanding of the invention and further objects, features and advantages thereof, reference may now be had to the following description taken in conjunction with the accompanying drawings.

DESCRIPTION OF THE PREFERRED EMBODIMENT

The present invention provides an improved internal gear motor or pump of the type shown in applicant's co-pending U.S. patent application, Ser. No. 860,715, filed May 6, 1986 now U.S. Pat. No. 4,699,577 and in U.S. Pat. No. 4,586,885. The operation of the internal gears and other parts of the machine are well known in the art and are described in these documents. The general description of the operation of these parts contained in these documents is not described herein, but for the purpose of these details, descriptions therein are hereby incorporated by reference.

Figure 1:
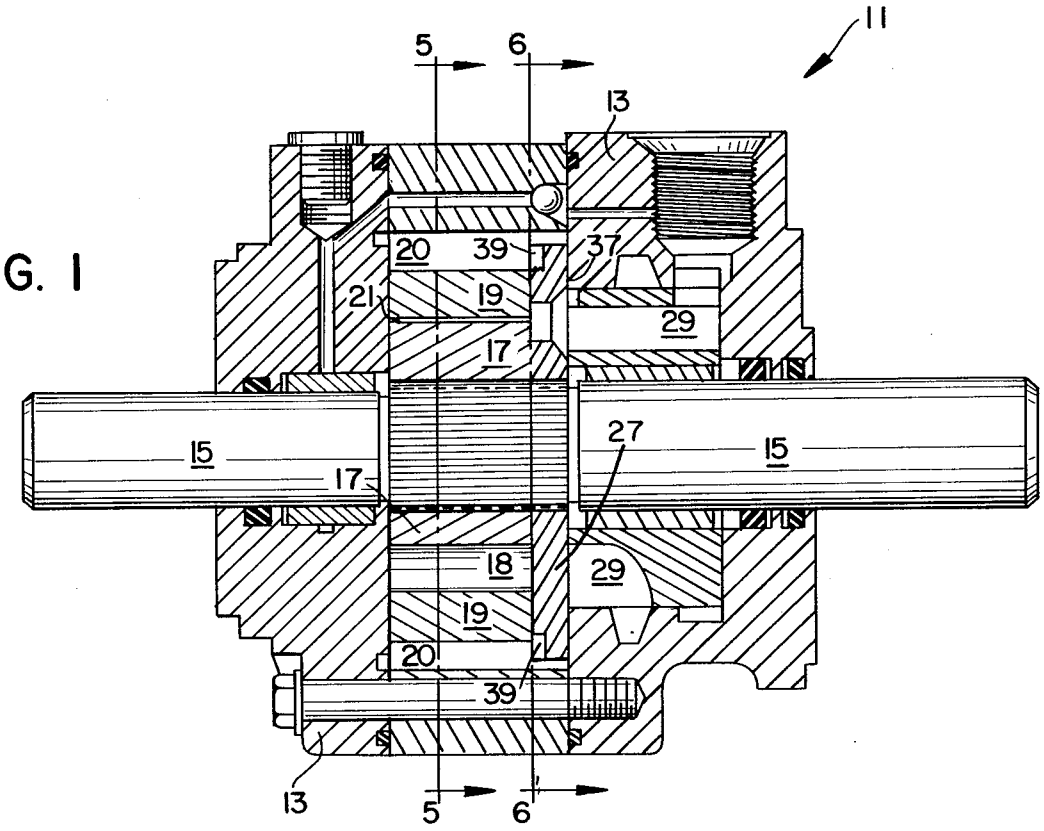
FIG. 1 is a cross sectional view of a portion of an internal gear machine of the present invention taken along the lines shown in FIG. 5.
Figure 5:
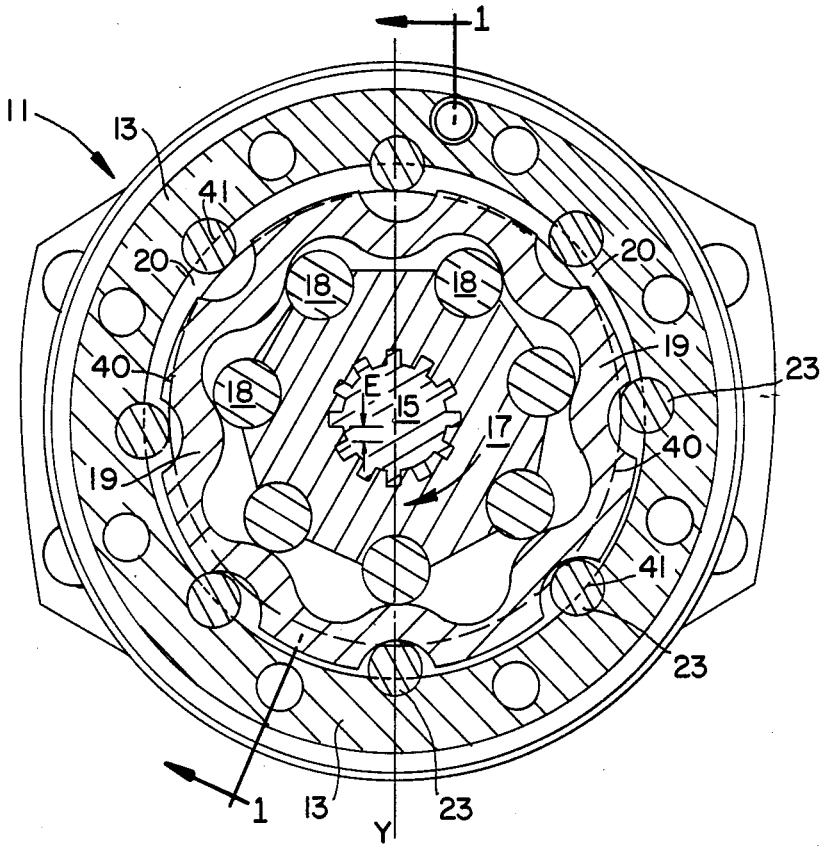
FIG. 5 is a cross sectional view of the internal gear machine of FIG. 1 taken along the lines shown in FIG. 1.
Figure 6:
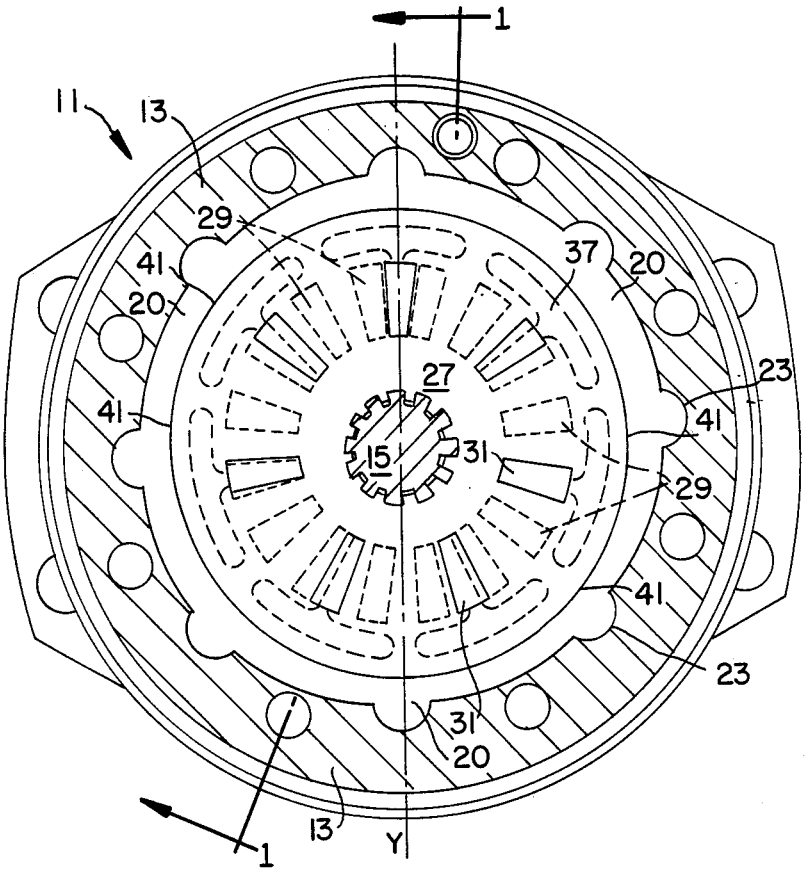
FIG. 6 is a cross sectional view of the internal gear machine of FIG. 1 taken along the lines shown in FIG. 1.

Referring now to FIG. 1 and FIGS. 5 and 6, a portion of an internal gear machine constructed in accordance with the present invention is shown at 11. The device includes a housing 13 which contains a rotatable shaft 15. Connected for rotation with the shaft 15 is an inner gear or gerotor 17. The inner gear 17 has rolls 18 extending around its periphery to form the teeth of the gear 17. An outer gear or rotor 19 meshes with the inner gear 17 such that variable displacement chambers 21 are formed therebetween. As seen best in FIG. 5, the outer gear or rotor 19 orbits as the inner gear rotates with the shaft 15. As the inner gear 17 rotates and outer gear 19 orbits, the variable displacement chambers 21 increase and decrease in volume and this increase and decrease is utilized to translate the shaft power of shaft 15 to hydraulic power of fluid conveyed to and from the chambers 21 (or vice versa in a motor as opposed to a pump).

The outside of gear 19 has semi-cylindrical recesses therein to receive rollers 23 extending about the space in housing 13 which receives the gear set 17, 19. The space in housing 13 which receives the gear set 17, 19 has a larger diameter than the outer diameter of the outer gear 19 so that the outer gear 19 is free to move in an orbiting motion as the inner gear 17 rotates and outer gear 19 remains meshed therewith as it moves. The space between gear 19 and housing 13 is an annulus 20. The annulus 20 contains fluid with a pressure intermediate the high and low pressure fluid in the inlet and outlet of the housing and gears. The intermediate pressure results from leak paths between the high and low pressure areas of the pump which communicate with the annulus 20.

As the gear set 17, 19 rotates and orbits, hydraulic fluid must be conveyed to and from the variable displacement chambers 21 therebetween. This is achieved by means of a commutator plate 25 and a valve plate 27. The commutator plate 25 is fixed with respect to the housing 13, while the valve plate 27 is rotatable with the inner gear 17. The valve plate 27 has a spline connection to shaft 15 to rotate with the shaft and gear 17.

Figure 2:
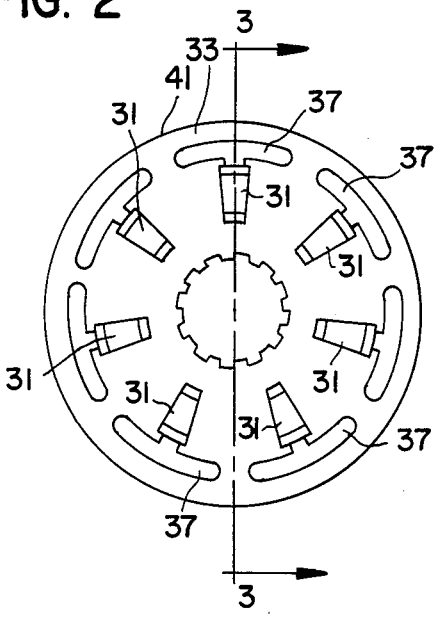
FIG. 2 is a front view of the valve plate illustrated in FIG. 1.
Figure 3:
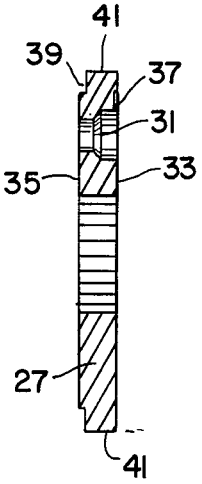
FIG. 3 is a cross sectional view of the valve plate shown in FIG. 2 taken along the lines shown in FIG. 2.
Figure 4:
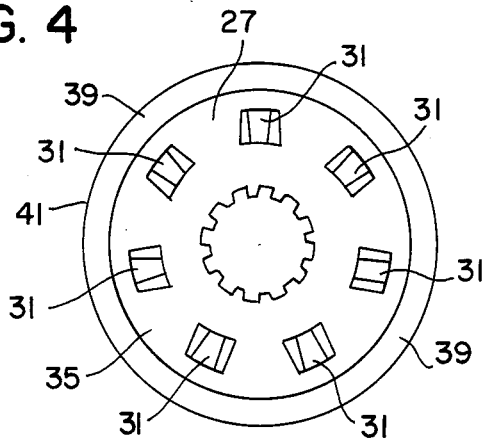
FIG. 4 is a rear view of the valve plate illustrated in FIG. 2 rotated 180° from the view of FIG. 2.

The commutator plate 25 has a plurality of openings 29 extending in a circular array about shaft 15. These openings 29 are connected to the inlet and outlet openings in housing 11 to convey hydraulic fluid to and from the variable displacement chambers 21 in the gear set 17, 19. To selectively connect the commutator openings 29 with the variable displacement chambers 21 at the proper time in the rotation and orbiting of the gear set 17, 19, the valve plate 27 has a plurality of valve plate openings 31 extending axially therethrough in a circular array as depicted in FIGS. 2–4. As the gear set 17 rotates together with the valve plate 27, the valve plate openings 31 open and close with respect to the commutator openings 29 to selectively communicate the inlet and outlet fluid to the opening and closing variable displacement chambers 21. This is best seen in FIG. 6 where the openings 29 in the commutator 25 are shown in dotted line beneath the valve plate 27 and its openings 31. Every other opening 29 is connected to the inlet of the housing and every other opening 29 is connected to the outlet of the housing. Thus, the rotating valve plate 27 sealingly separates the gear set 17, 19 from the commutator 25 except for the proper conveyance of fluid to and from the selected set of openings 29 through the openings 31. The valve plate 27 achieves this sealing separation by the close fit of the surfaces between the gear set 17, 19, the commutator 25, the housing 13, the shaft 15 and the exterior surfaces of the valve plate 27.

The valve plate 27 has a commutator front side 33 shown in FIG. 2 and a gear set rear side 35 shown in FIG. 4. A well known problem with valve plates is that the valve plate is subjected to a tilting moment caused by one radial half of the valve plate being subjected to high pressure, while the other radial half of the valve plate is subjected to low pressure. This occurs on the gear set side 35 of the valve plate 27 since one radial half of the variable displacement chambers 21 are decreasing in volume (high pressure) while the other radial half are increasing in volume (low pressure). As described in U.S. Pat. No. 4,411,607, a partial solution to this problem is to provide the arcuate recesses 37 in the commutator side of the valve plate 27. These recesses 37 provide a partial counterbalance to the high pressure on the gear set side 35 of the valve plate 27. No compensation is provided on the gear set side 35 to correct the tilting moment due to high pressure ports covered on the commutator side 33. This problem is described in applicant's co-pending patent application Ser. No. 860,715.

The present invention provides a solution to this further tilting moment without requiring fluid from the commutator side of the valve plate to be conveyed to the gear set side of the valve plate through special ports. It also provides a solution for the orbiting outer type of machine where the special ports can not function. To provide this balance, a continuous recess 39 is provided on the gear set side 35 of the valve plate 27. The inner radial extent of the recess 39 is a shoulder 40. The recess 39 extends continuously around the valve plate 27 adjacent the periphery 41 of the valve plate 27 so as to form a step which can receive fluid from the gear set side 35 of the valve plate 27. The positioning of the shoulder 40 and the periphery 41 are shown in dotted line in FIG. 5. The fluid received in the recess 39 provides a uniform axial pressure opposing that provided by the high pressure openings in the commutator side of the valve plate 27 opposite the low pressure displacement chambers in the gear set. In this way the tilting moment resulting from the imbalance is corrected.

By means of this fluid pressure, the recess 39 balances the tilting moment which would otherwise be present due to the unbalanced high pressure and low pressure forces acting on the opposite sides of valve plate 27. This is achieved while sealingly separating the fluid which fills the recess 39 from the openings 29 in the commutator 25. The sealing is provided by the exterior surfaces of the valve plate 27 which fit closely within the housing 13 and the commutator 25 and the gear set 17, 19. The size of the recess 39 required to balance the unbalanced forces depend on the sizes of the commutator and valve plate openings, the area of the variable displacement chambers, the inlet pressure, the outlet pressure, the intermediate pressure, and the area of the recesses on the valve plate side. In most instances the size of the recess 39 to balance the imbalance is sufficiently small so that a sealing area between the intermediate pressure annulus and the displacement chambers is maintained as shown in FIG. 5.

Thus, the valve plate and internal gear device of the present invention is well adapted to obtain the objects and advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

The foregoing disclosure and the showings made in the drawings are merely illustrative of the principles of this invention and are not to be interpreted in a limiting sense.

What is claimed is:

1. An improved internal gear machine of the type having a gear set defining variable displacement chambers as the gear set rotates in a housing with the outer gear orbiting in an annulus having intermediate pressure therein, a commutator disposed axially with respect to the gear set and having inlet and outlet openings therein for conveying fluid to and from the variable displacement chambers, and a rotatable valve plate connected for rotation with the inner gear and disposed sealingly between the gear set and the commutator to selectively convey inlet and outlet fluid therebetween by means of a plurality of valve plate openings extending axially through the valve plate; the improvement comprising:

said valve plate having a periphery and a gear set side with a recess formed in said valve plate and extending about the gear set side of the valve adjacent the periphery so that intermediate pressure fluid from the annulus is communicated to said recess and urges said valve plate toward said commutator to balance the forces of high pressure fluid in the commutator openings opposing low pressure fluid in the variable displacement chambers across said valve plate.

* * * * *